US006396378B1

(12) United States Patent
Leupold

(10) Patent No.: US 6,396,378 B1
(45) Date of Patent: May 28, 2002

(54) FINE TAPER ADJUSTMENT IN A MAGIC CYLINDER

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/956,740

(22) Filed: Sep. 17, 2001

(51) Int. Cl.[7] ..... H01F 7/02
(52) U.S. Cl. ..... 335/306
(58) Field of Search ..... 335/296–306

(56) References Cited

U.S. PATENT DOCUMENTS 4,862,128 A * 8/1989 Leupold ..... 335/306
5,216,400 A * 6/1993 Leupold ..... 335/306

* cited by examiner

*Primary Examiner*—Ramon M. Barrera
(74) *Attorney, Agent, or Firm*—Michael Zelenka; George B. Tereschuk

(57) ABSTRACT

A variable tapered magic cylinder structure that is constructed from two or more permanent magnet shells, with the first shell being oriented and magnetized to produce a first working magnetic field with a given taper, and a second shell oriented and magnetized to produce a second magnetic field with a given taper that interacts with the first magnetic field. The two magnetic shells are assembled in a way to rotate about a common shared internal cavity and concentric cylindrical axis to form a working space, with the first and second working fields interacting with each other to form a tapered working magnetic field along a polar plane perpendicular to the concentric axis with a given pitch. This structure allows one to adjust or vary the tapered magnetic field along the polar plane to advantageously provide an adjustable composite tapered magnetic field. Also provided are a variable tapered magic cylinder device, a method for adjusting a tapered magnetic field and a method of adjusting a tapered magnetic field in a magic ring structure.

68 Claims, 8 Drawing Sheets

FINE TAPER ADJUSTMENT IN A MAGIC CYLINDER

RELATED APPLICATION

This application is related to the applicant's co-pending application entitled "Magic Cylinder Adjustable in Field Strength," designated as U.S. patent application Ser. No. 09/629,756.

GOVERNMENT INTEREST

The invention described herein may be manufactured used, and licensed by or for the Government for governmental purposes without the payment to me of any royalty thereon.

FIELD OF THE INVENTION

The present invention relates to the field of permanent magnet structures and, more particularly, to permanent magnet structures that produce a working magnetic field that tapers in strength with progression along the magnetic axis.

BACKGROUND OF THE INVENTION

Permanent magnet structures that produce a working magnetic field are well known in the art. The term "working magnetic field" as used herein refers to a magnetic field that is used to do some type of work. A magnetic field used to guide or focus an electron beam is an example of such a working magnetic field.

Some permanent magnet structures are composed of pieces of permanent magnet material arranged to form a shell having an interior cavity. Each piece of permanent magnet material has a magnetization that adds to the overall magnetization of the shell. Depending on the magnetization of the shell, a permanent magnet structure can be designed to produce a magnetic field having a given magnitude along a given axis in the working space located in the cavity of the shell.

Permanent magnet structures may also be designed to provide a working magnetic field having a magnitude or strength that can be mechanically adjusted. Such structures are typically composed of two permanent magnet shells, each producing a working magnetic field in their respective cavities. The shells are arranged such that their internal cavities form a working space within the common internal cavity. Such an arrangement enables the working magnetic fields to interact in the working space to produce, e.g. by vector addition, a composite working magnetic field having a composite magnitude. In addition, the shells are arranged such that they can rotate independent of each other around the concentric axis within the common internal cavity. The ability to rotate permits the user to change the vector relationship between the working magnetic fields produced by each shell. As a result, components of the composite working field in the working space can be adjusted or changed by rotating one shell with respect to the other. For example, U.S. Pat. No. 4,862,128, entitled "Field Adjustable Transverse Flux Source," issued to the inventor herein on Aug. 29, 1989, describes obtaining an adjustable working magnetic field by assembling two cylindrical shells, known as "magic" rings or magic cylinders, and rotating the shells to change the magnitude of the working magnetic field in the cavity.

Until now, there has been no available permanent magnet structure to generate an adjustable tapered working magnetic field in the magnetic axis of the working space and common internal cavity of the shells. A tapered working magnetic field is a working magnetic field that changes from a greater magnitude to a lesser magnitude along an axis in the shell cavity. This inventor's U.S. Pat. No. 5,216,400, entitled "Magnetic Field Sources For Producing High-Intensity Magnetic Fields", discloses a magnetic shell formed from either the magic ring or a segmented sphere that produces a tapered working magnetic field along a transverse axis in its internal cavity when the remenance or magnetization of each piece of the shell varies as a function of its polar angle from the axis. However, once that tapered magnetic field is assembled, the working magnetic field generated in its cavity is fixed and non-adjustable. Until now, permanent magnetic structures have not provided a means for varying the taper or the pitch of the taper from a greater magnitude to a lesser one. Thus, there is a long-felt need for a permanent magnetic structure that permits adjusting, varying or fine-tuning the taper of the working field and does not suffer from the disadvantages, limitations and shortcomings of fixed taper magnetic structures.

SUMMARY OF THE INVENTION

It is therefore one object of the present invention to provide a device and methods for adjusting a tapered working magnetic field.

It is another object of the present invention to provide a device and methods for adjusting a tapered working magnetic field in permanent magnetic structures.

It is still a further object of the present invention to provide a permanent magnetic structures device composed of magic rings that provides an adjustable tapered working magnetic field, and methods for making same.

To attain these objects and advantages, a permanent magnet structure of the present invention composed of two or more permanent magnet shells is provided, with the first shell being oriented and magnetized to produce a first working magnetic field with a given taper, and a second shell oriented and magnetized to produce a second magnetic field with a given taper that interacts with the first magnetic field. The two magnetic shells are assembled in a way to rotate about a common shared internal cavity and concentric cylindrical axis to form a working space, with the first and second working fields interacting with each other to form a tapered working magnetic field perpendicular to the concentric axis with a given pitch. This structure allows one to adjust or change the magnitude and pitch of the tapered magnetic field along the field axis to advantageously provide a working magnetic field with an adjustable taper.

In particular embodiments, the permanent magnet structures of the present invention comprise at least two permanent magnet shells, with the first shell producing a first working magnetic field with a given taper, and a second shell producing a second magnetic field. Each permanent magnetic shell further comprises a group of magnetic sections that collectively produce a tapered magnetic field. The taper is collective because the assembly of the sections produces the taper. In some embodiments, the magnetic sections are wedge-shaped. The two shells are assembled to share a common internal cavity wherein the first and second working fields interact with each other to form a tapered working magnetic field along the shells' polar plane in the z direction with a given pitch. The magnetic shells may further comprise a plurality of magnetic shells that all rotate about a common internal cavity. Whenever the first and second magnetic shells rotate around the common internal cavity, this movement or rotation of either shell directly affects the interaction, by geometric addition, of the magnetic fields, and thereby also affects the pitch of the tapered working magnetic field produced in the working space along the magnetic axes and parallel thereto. As a result, one can adjust or change the magnitude and pitch of the tapered magnetic field in the common internal cavity by changing or rotating the relative position of one shell within a set of shells, or rotating one shell with respect to the other, thus advantageously providing a working field with an adjustable taper. One embodiment of this invention provides a variable magic cylinder magnetic structure comprising two or more magic rings. The present invention also encompasses a method for adjusting a tapered magnetic field and a method of adjusting a tapered magnetic field in a magic ring structure.

These and other features of the invention will become more apparent from the Detailed Description when taken with the drawings. The scope of the invention, however, is limited only by the claims.

DETAILED DESCRIPTION OF THE DRAWINGS

The variable tapered magic cylinder of the present invention comprises two or more hollow, substantially cylindrical shells nested to form a common internal cavity and a working space. Each set of permanent magnetic shells is composed of a group of magnetic segments, wherein each segment produces a tapered magnetic field. The segments can be wedge-shaped and assembled to form magic ring structures that produce uniform fields in their internal cavities. The shells are arranged for one shell to be embedded, or nested, within the other shell such that they are axially aligned and such that the outer radius of the inner shell is equal to the inner radius of the outer shell. The first permanent magnetic shell is somewhat larger than the second magnetic shell. The first shell is magnetized and oriented to produce a first working magnetic field in the working space along a polar plane or magnetic axis. The second shell is magnetized and oriented to produce a second working field having a given taper in the working space along the polar or magnetic axis. The first and second working fields interact in the common internal cavity to form a composite working magnetic field having a given magnitude and pitch. The magnitude and pitch of the composite working magnetic field can thereby be adjusted by rotating both shells or one set of shells with respect to the other to advantageously allow adjusting, varying or fine-tuning the taper of the working field without suffering from the disadvantages, limitations and shortcomings of fixed taper magnetic structures.

Figure 1:
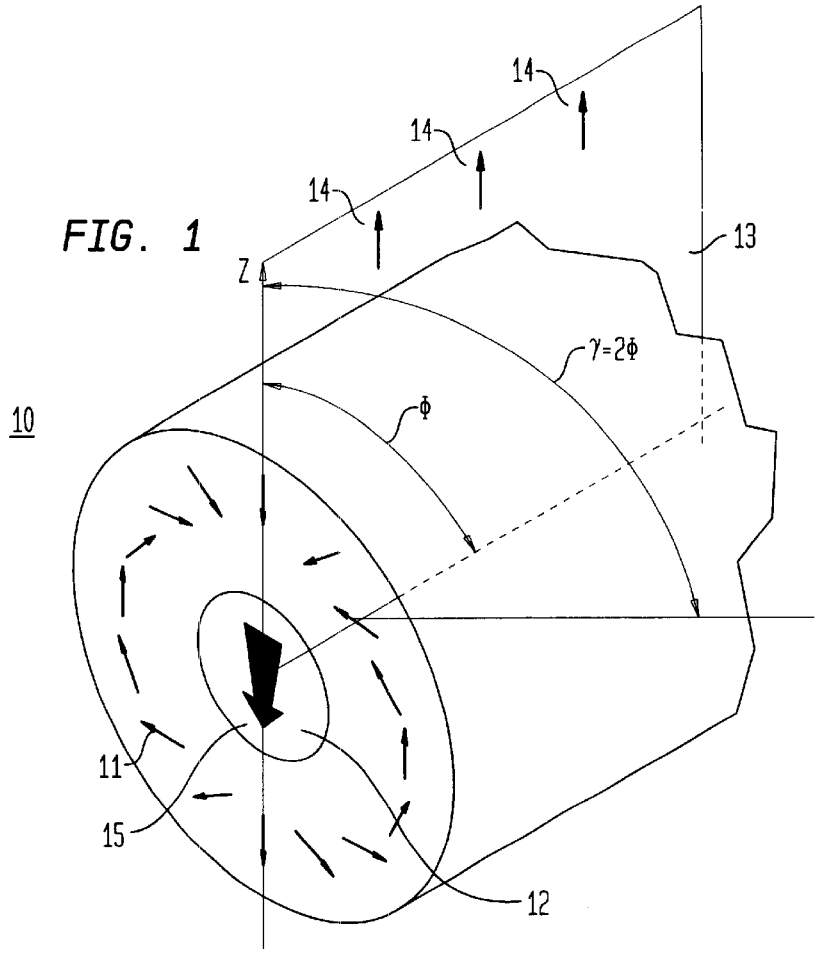
FIG. 1 is a perspective view of an ideal magic cylinder magnetic structure and a polar plane.

Referring now to the drawings, FIG. 1 is a perspective view of an un-tapered ideal magic cylinder magnetic structure 10 with a single cylindrical shell 11 enclosing cylindrical cavity 12 and a polar plane 13. Small upright arrows 14 also depict the magnetic axes of this structure. Large arrow 15 depicts the magnetic field projecting downward. Cylindrical shell 11 is magnetized with uniform strength but with a direction of magnetization, γ, with respect to the magnetic axis varying continuously as:

$$\gamma=2\phi \tag{1}$$

where ϕ is the angular cylindrical coordinate in question. This results in a uniform field H in the cylindrical cavity 12 according to the formula:

$$H=B_r \ln(r_o/r_i) \tag{2}$$

where $B_r$ is the magnetic remanence and $r_o$ and $r_i$ are the outer and inner radii, respectively, of cylindrical cavity 12. Such structures can produce unusually high fields with comparatively little material.

Figure 2:
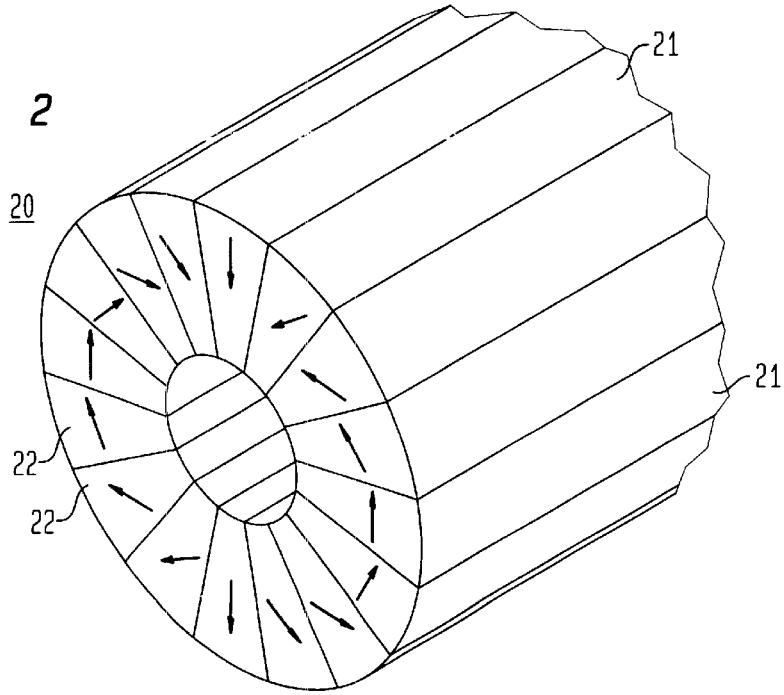
FIG. 2 is a perspective view of a segmented approximation of a magic cylinder structure.

Referring now to FIG. 2, in practice a magic cylinder 20 is approximated by rings composed of wedge-shaped segments 21, wherein the direction of magnetization varies from one segment 21 to the next in discrete increments shown by arrows 22 in contrast to the continuous variation of the FIG. 1 ideal cylinder. The FIG. 2 approximation of the ideal magic cylinder does not substantially affect the working field for a sufficient number of segments. For example, a sixteen-segment structure produces better than 99% of the magnetic field furnished by the ideal magic cylinder structure. This can be improved to a desirable degree of precision by using more and smaller segments.

Figure 3:
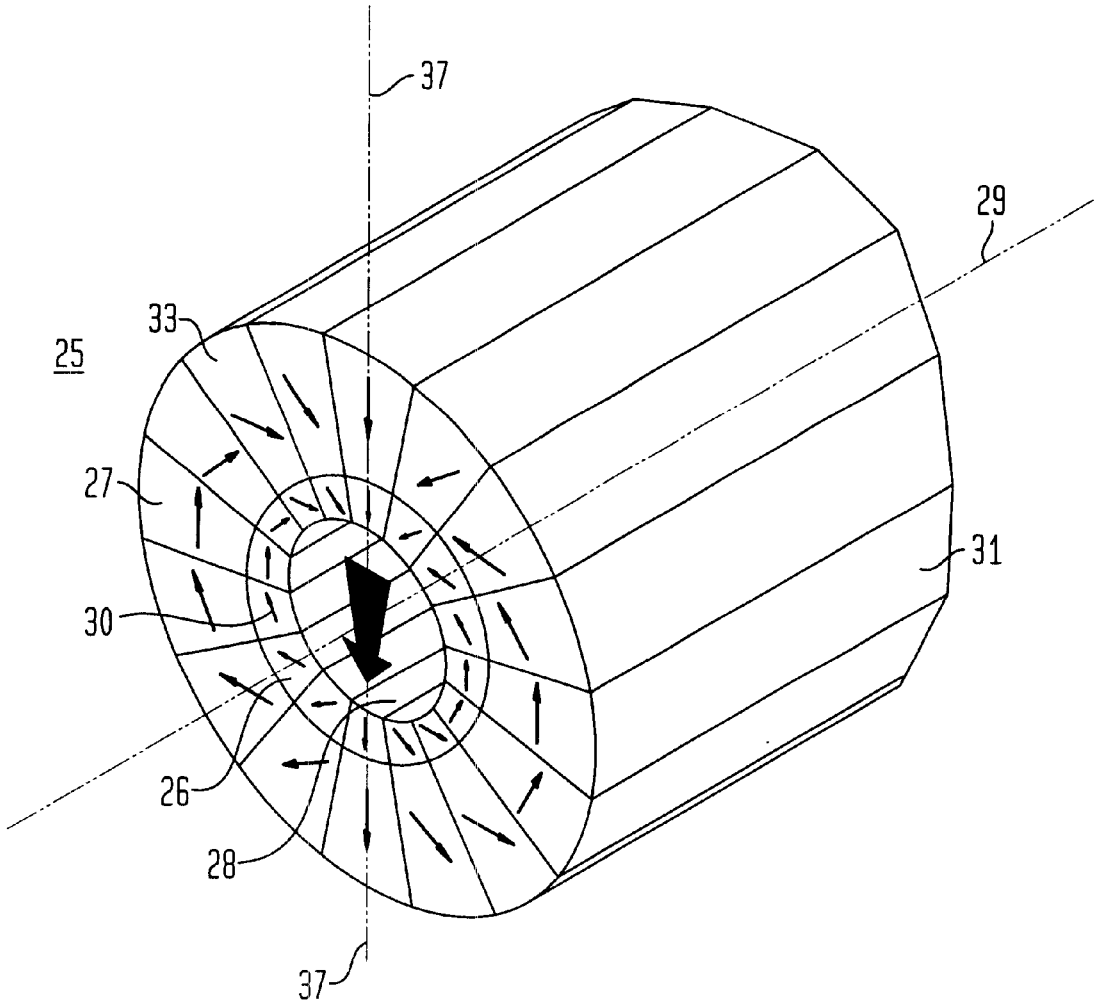
FIG. 3 is a perspective view depicting two nested FIG. 2 magic cylinders.

The operations and techniques employed in the variable tapered magic cylinder of the present invention will be better appreciated by examining the underlying theoretical concepts of magnetic field vector addition in more detail in FIGS. 3–7. FIG. 3 depicts two nested magic cylinders of the type shown in FIG. 2 rotated with respect to each other. When two FIG. 2 type magic cylinders are rotated with respect to each other, their magnetic fields in the interior add vectorially. Even when rotated with respect to each other by the same amount in the same direction, the two magnetic fields will still add vectorially and decrease, as the angles get bigger until at 90° it is reduced to zero. FIG. 3 depicts a magnetic structure 25 composed of two magnetic shells which are each magic cylinders with an inner cylinder 26 nested within the outer cylinder 27, a common internal cavity 28 and a concentric cylindrical axis 29, with the necessary dimensions for each cylinder to produce magnetic fields of equal strength. Inner cylinder 26 is composed of a group of inner segments 30 and outer cylinder 27 is composed of a group of outer segments 31. Small arrows 33 depict the direction of magnetization in each segment. FIG. 3 depicts the inner magic cylinder 26 and outer magic cylinder 27 being oriented with their polar planes aligned. Polar plane 37 is perpendicular to concentric cylindrical axis 29 and intersects it within the common internal cavity 28.

Figure 4A:
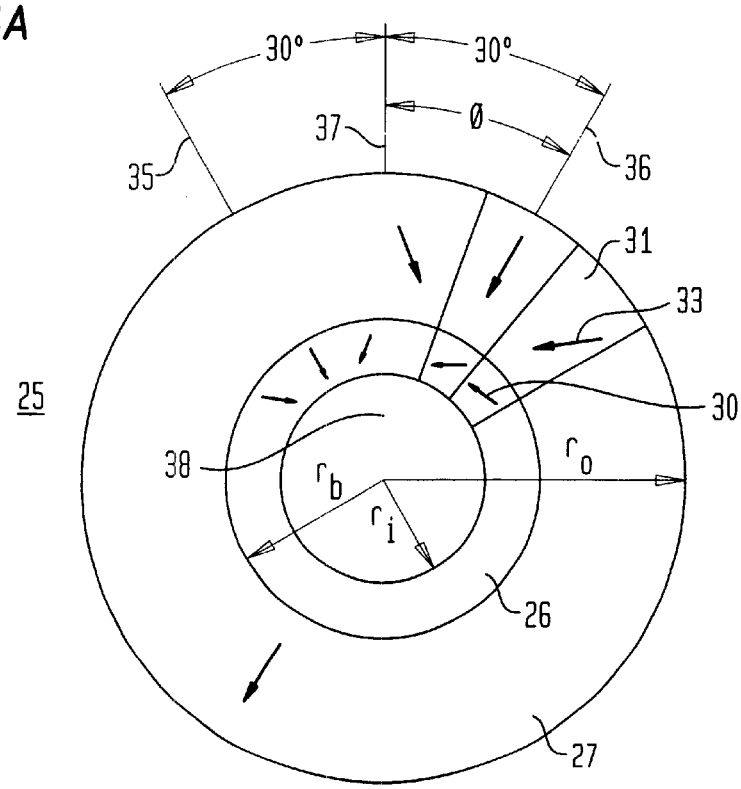
FIGS. 4A–4B are a front conceptual view of the vector addition of the FIG. 3 nested magic cylinders wherein the angles of rotation are +30° and −30°.

FIG. 4A is a front conceptual view of the same magnetic structure 25, using like numerals for similar structural elements, depicting vector addition of the two nested magic cylinder magnetic structures 26 and 27, respectively, and an outer radius, $r_o$ and the inner radius, $r_i$. For the sake of simplicity, only a few magnetization direction arrows 33 and segments 30 and 31 are shown in this drawing. Also, depicted are the inner cylinder polar plane 35 and an outer cylinder polar plane 36 that combine to form a composite polar plane 37 and composite working magnetic field 38. In this nested arrangement, when magnetic cylinders 26 and 27 are rotated with respect to each other, the FIG. 4A magnetic fields will add vectorially as in FIG. 4B.

Figure 4B:
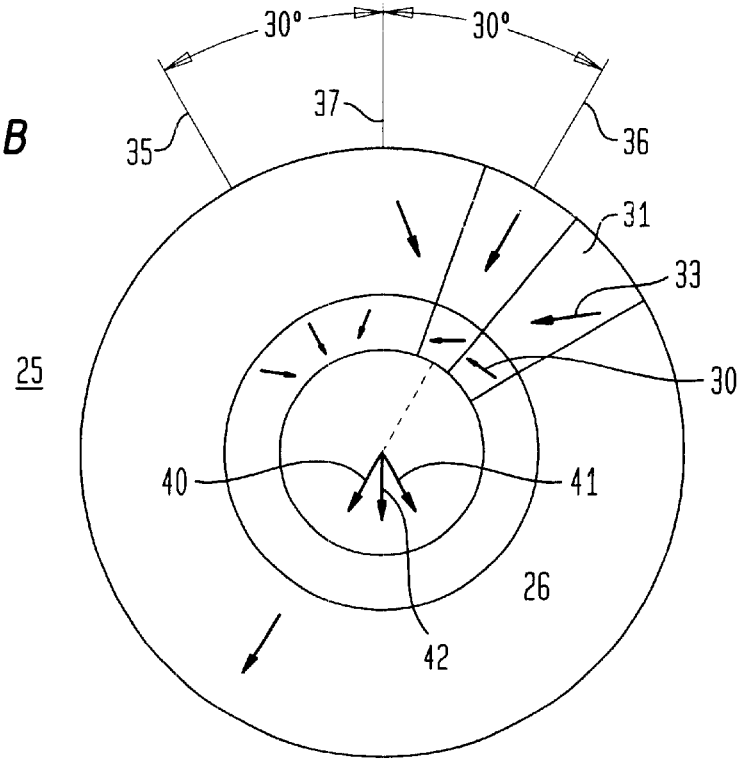

In the structure depicted in FIGS. 4A and 4B, all magnetic fields from $2H_i$, where $\theta=0°$ to zero at $\theta=90°$ are thus obtainable where $\theta$ is the half angle separating the cylinder orientations and $H_i$ is the field produced by one cylinder. For the magic cylinder structures 26 and 27 to produce equal magnetic fields, the radius, $r_b$, of the circular boundary separating the cylindrical shells must be the geometric mean between the radius of the inner cavity, $r_i$, and the radius of the outer surface of the larger cylindrical shell according to the formula:

$$r_b=\sqrt{r_i r_o} \tag{3}$$

When the two magic cylinders 26 and 27 are rotated by $\theta$, $-\theta$ respectively, the composite polar plane magnetic axis 37 depicted in FIG. 3 maintains its original direction and the field, though decreasing with increasing $\theta$, it remains parallel to the magnetic polar plane. Those lateral components that are perpendicular to polar plane 37 will cancel due to the mirror symmetry of the configuration. FIG. 4B also depicts an inner cylinder magnetic field 40, an outer cylinder magnetic field 41 and composite magnetic field 42.

The field of a magic cylinder can be made to vary with progress along a magnetic axis, and in many cases this variation can be linear over a large portion of the axis length. If one varies the value of $B_r$ linearly with the angle $\phi$:

$$B_r(\phi)=B_r \max \phi/\pi \tag{4}$$

Here $B_{r\ max}$ is the largest value of $B_r$ used. If this is done, then $H_{(x)}$ will vary linearly with distance z along the FIG. 3 composite polar plane 37 as:

$$H(z)=cz \tag{5}$$

where c is a constant. If one does not desire the magnetic field to go to zero at one of the cavity edges, one can add to equation (4) a constant, $B_r$ $(\pi/2)$, so that:

$$B_r(\phi)=B_r^{max}\ \phi/\pi+B_r(\pi/2) \tag{6}$$

The $B_r$ at $\pi/2$ is the minimum used.

$$B_r(\pi/2)=B_r^{min} \tag{7}$$

Figure 5A:
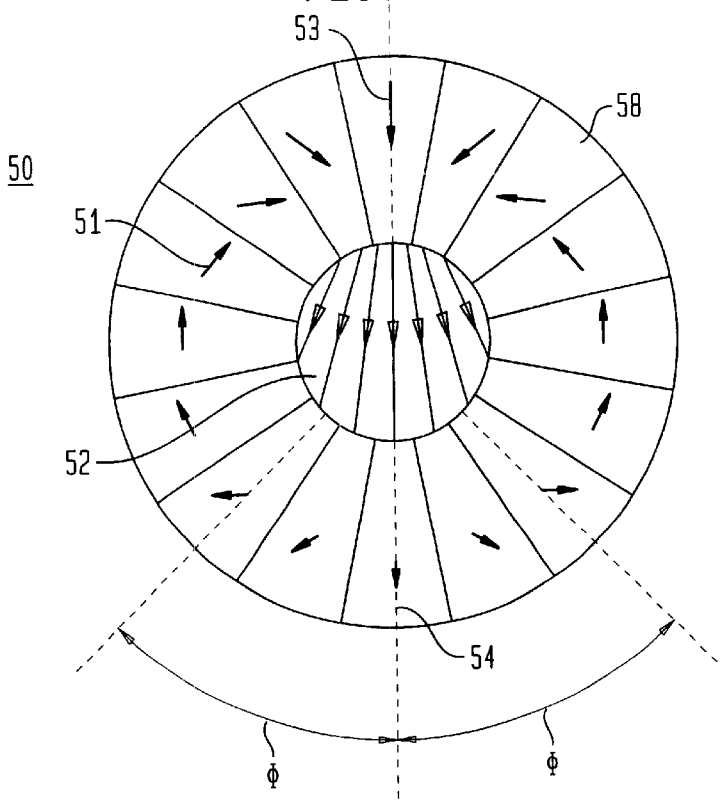
FIGS. 5A–5B are a front conceptual view of a single field-tapered magic cylinder and a group of nested FIG. 5A magic cylinders.
Figure 5B:
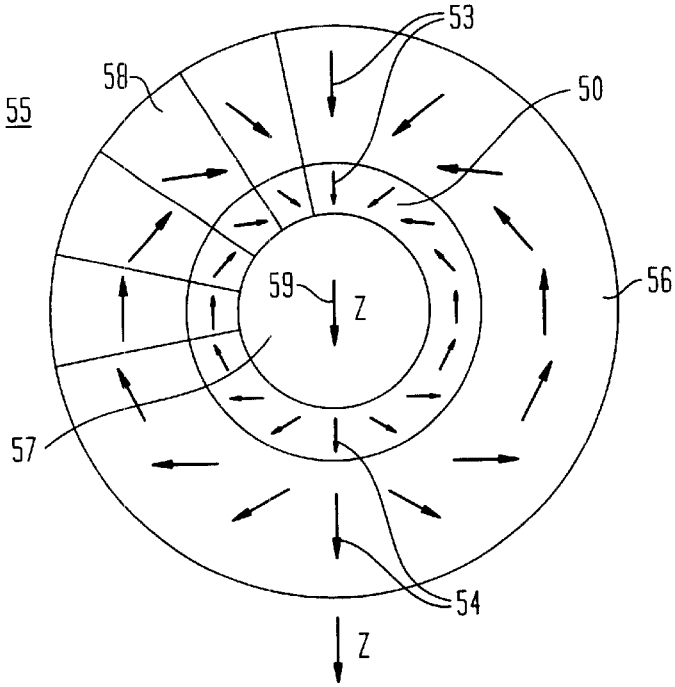

FIG. 5A, which is a front conceptual view of a single field-tapered magic cylinder 50, illustrates the linear increase in the length of the small arrows 51 and depicts the relative values of $B_r(\phi)$ with an increasing $\phi$. In such structures as those depicted in FIGS. 5A and 5B, the field lines 52 "fan out" with progression from the strong to weak field as shown in FIG. 5A. FIG. 5A also depicts $B_r^{max}$ 53 and $B_r^{min}$ 54. In accordance with the present invention, when two such nested shells 50 with $B_r(\pi/2)=0$ are aligned as shown in FIG. 5B, their axial fields combine vectorially as in the case of uniform field cylinders so that the axial field doubles everywhere so that the gradient doubles as well. FIG. 5B is a front conceptual view of the variable tapered magic cylinder 55 of the present invention showing two nested FIG. 5A-type magic cylinders 50 and 56 and common internal cavity 57, with like numerals for the same or similar structural elements. There is, of course, no transverse field since $\sin\theta=0$.

Referring now to FIG. 5B, since the inner shell 50 and outer shell 56 scale proportionately to size, the magnetic fields at corresponding geometric points will be the same, but because the dimensions of inner shell 50 are smaller, its gradient will be larger in the proportion expressed in the equation:

$$r(\text{outer shell})/r(\text{inner shell}) \tag{8}$$

To make the gradient equal and thereby assure continued polar symmetry upon mutual rotation of the inner shell 50 and outer shell 56, one can increase the remanence of the inner shell 50, $B_r^i(\phi)$, over those of the corresponding segments of the outer shell 56, $B_r^o(\phi)$, by a factor r (outer shell)/r (inner shell), according to the following formula:

$$B_r^i(\phi)={}_r^o/_r^i B_r^o \tag{9}$$

When the mutual angular displacement $2\theta$ of nested shells 50 and 56 is not zero, the fields due to each individual cylinder add vectorially, to produce a composite tapered field 59 within common internal cavity 57 that tapers approximately linearly with distance along the polar direction, z. As in the case of the untapered nested cylinders, the composite field will decrease with increasing $\theta$, but now the taper along z will decrease as well, reaching zero at $\theta=\pi/2$. In contrast to the untapered cylinders, the nested tapered shells of the present invention show no cancellation of the transverse field, except in the composite polar plane. These points are illustrated in FIGS. 6–9. For the sake of simplicity, only a few segments 58 are depicted in FIG. 5B.

Figure 6A:
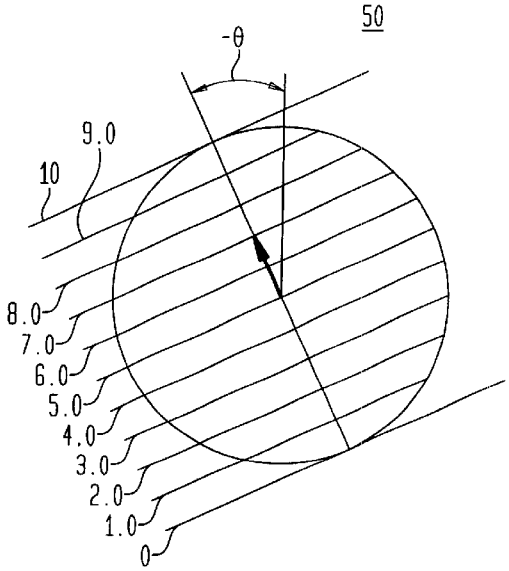
FIGS. 6A–6B are front conceptual views of constant axial field lines of nested cylindrical shells 5A and 5B and their vector sum shown in FIG. 6C.
Figure 6B:
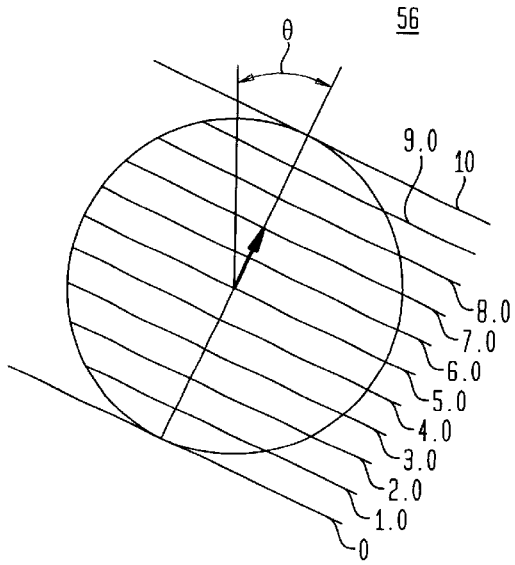
Figure 6C:
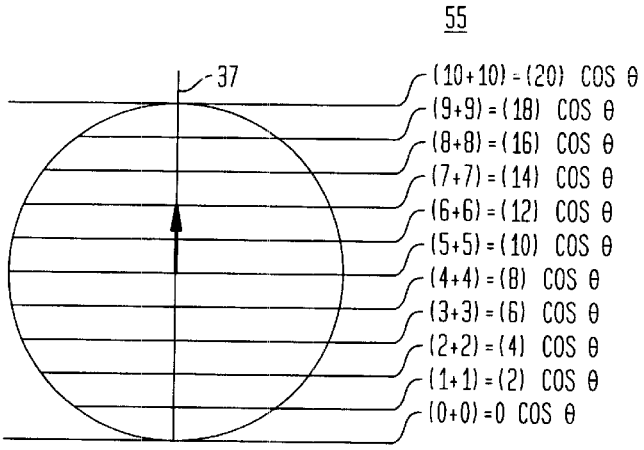

Referring now to FIGS. 6A–6B, the magnetic fields of shells 50 and 56, respectively, are depicted individually for those cases where $\theta$ is not zero. For the sake of clarity, assume that the trapezoidal field-line configuration consists of parallel lines, which is approximately true only if the total gradient of the working space is small compared to the average field and serves as a useful approximation for many cases. The lines in FIGS. 6A–6C are the constant field lines with FIG. 6C showing the composite sum of the FIG. 6A and 6B magnetic fields at the composite polar plane 37. These drawings demonstrate that the FIGS. 6A and 6B axial field components add to give the axial fields components of FIG. 6C, which are twice the strengths of either the FIG. 6A inner shell 50 or the FIG. 6B outer shell 56 multiplied by the cosine of $\theta$. Unlike the case of the cylindrical shells of uniform field depicted in FIGS. 6A and 6B, the transverse fields no longer cancel for $\theta$'s greater than zero except on the axis. These fields are maximum at the cavity edge when $\theta$ is 90° and are then equal in strength of ten kilogauss (kG) as in the case illustrated in FIGS. 6A–6C.

Figure 7A:
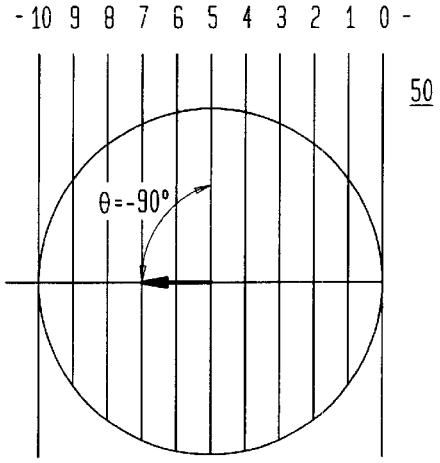
FIGS. 7A–7C are front conceptual views of lateral magnetic fields of nested cylindrical shells 5A and 5B and the composite lateral field shown in FIG. 7C.
Figure 7B:
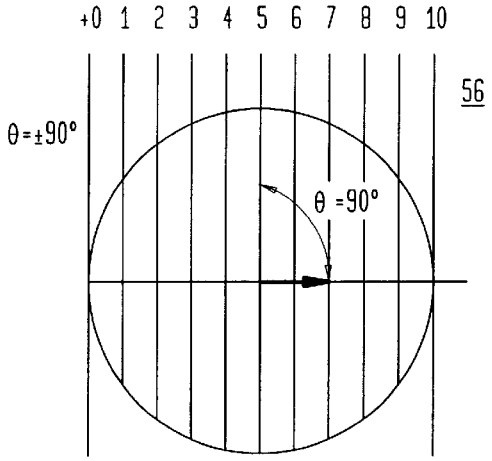
Figure 7C:
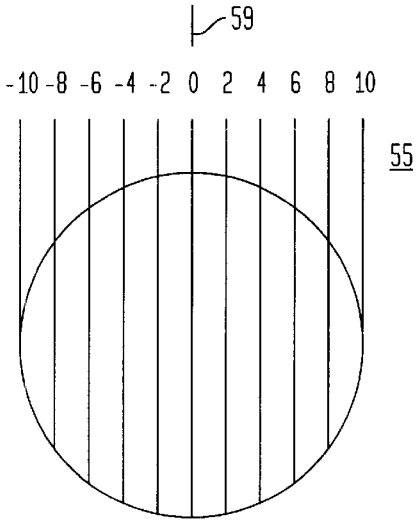

FIGS. 7A–7C depict lateral magnetic fields in FIG. 7A inner shell 50 and FIG. 7B outer shell 56 and a composite tapered magnetic field 59 in FIG. 7C when θ=90°. The composite lateral magnetic fields are given by to the formula:

$$H^1 \sin \theta + H^2 \sin(-\theta) \quad (10)$$

where $H^1$ and $H^2$ are the fields due to the individual cylinders at the points in question.

Figure 8:
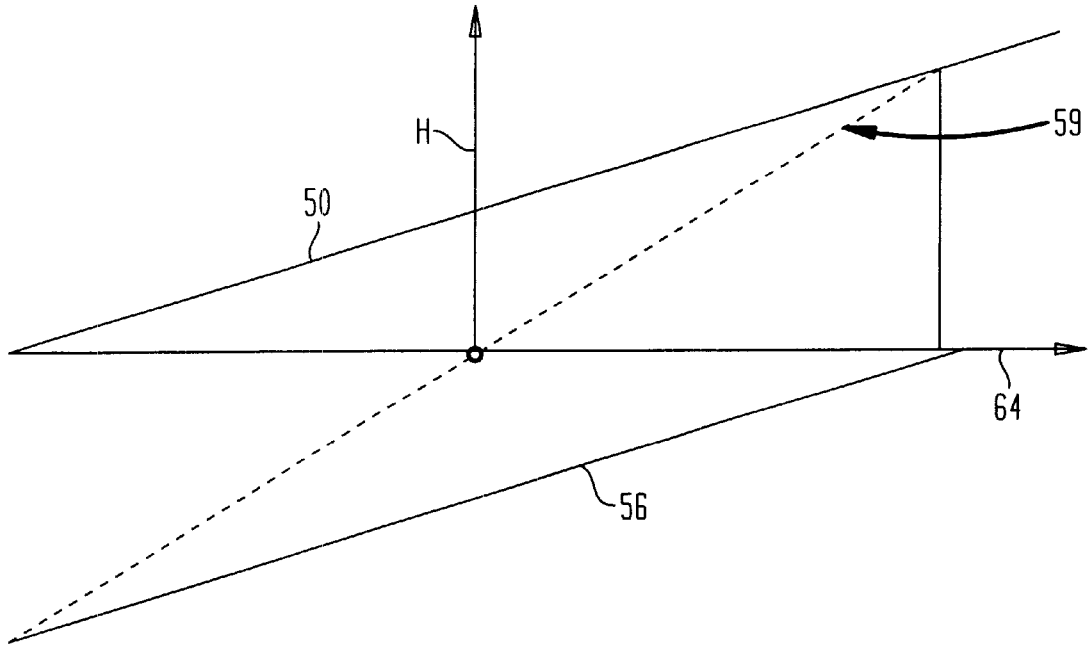
FIG. 8 is a conceptual diagram of lateral magnetic fields along an equatorial diameter.

Referring now to FIG. 8, which is a conceptual graph of lateral magnetic fields along the same equatorial diameter where θ=90° as in FIGS. 7A–7C, where the lateral field is zero at center. In this diagram, line 50 represents inner shell 50, line 56 represents the lateral field of outer shell 56 and arrow H represents the lateral magnetic field. Broken line 59 represents the composite tapered magnetic field 59, which is depicted intersecting the x axis 64 at center, 0, of the cavity. The lateral field depicted in FIG. 8 is zero at center, even that portion due to the ignored field taper in perfectly aligned cylinders. Elsewhere the ignored taper would have the effect of increasing the angle of taper caused by the axial projections of the individual fields of the inner and outer shells 50 and 56, respectively, as discussed above.

Thus, based on these drawings and their associated principles, it is clear that the first and second working fields interact in the common internal cavity to form a composite working magnetic field having a given magnitude and pitch and that the first and second working magnetic fields are added vectorially. These drawings and their associated principles also demonstrate that the magnitude and pitch of the taper of the composite working magnetic field can be adjusted by rotating one cylinder with respect to the other cylinder, or rotating a shell within a set of shells to advantageously allow adjusting, varying or fine-tuning the taper of the working field without suffering from the disadvantages, limitations and shortcomings of fixed taper magnetic structures.

Figure 9:
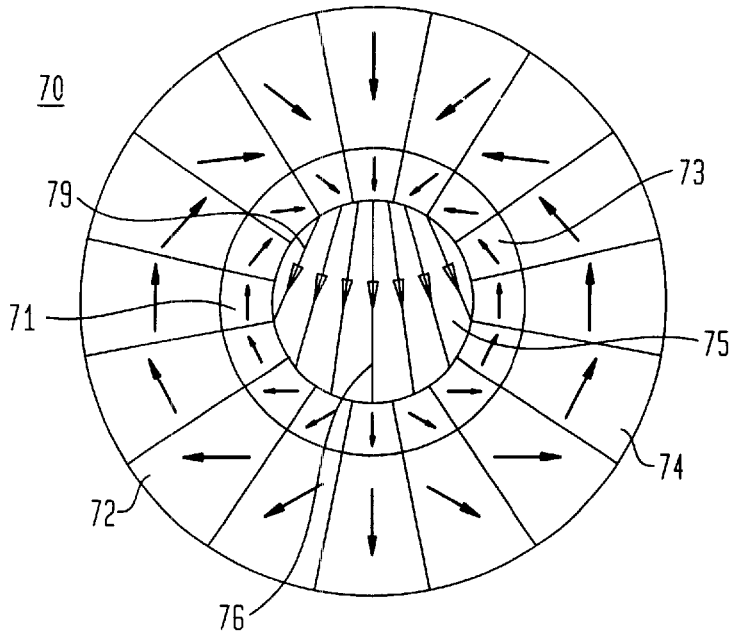
FIG. 9 is a front conceptual view of the view of the variable tapered magic cylinder of the present invention showing the fanning out of field lines with increasing rotation of the angle, θ.

Referring now to FIG. 9, the variable tapered magic cylinder structure 70 of the present invention is depicted when the inner shell 71 and outer shell 72 are aligned. Inner shell 71 is composed of a plurality of inner magnetic segments 73, with each segment having its own tapered magnetic field. Outer shell 72 is composed of a plurality of outer magnetic segments 74, with each segment having its own tapered magnetic field. In this embodiment, the inner and outer shells 71 and 72 are tapered magic ring structures. For the sake of clarity, only a few inner and outer segments 73 and 74 are shown in this drawing. The shells are configured so that inner shell 71 is embedded within outer shell 72, with the outer shell 72 forming a magic ring that is somewhat larger than the magic ring formed by the inner shell 71. These dimensions allow movement of the inner shell 71 and outer shell 72 either alone or with respect to each other. The inner and outer shells 71 and 72 are configured for axial alignment along the polar plane 76 within common internal cavity 75. Inner shell 71 is magnetized and configured to produce a first tapered magnetic field in the common internal cavity 75. The outer shell 72 is also magnetized and produces a second working field having the same taper along the polar plane 76 within the working space in common internal cavity 75. In the aligned position, field lines 79 "fan out" within common internal cavity 75. Thus in accordance with the present invention, the tapered magnetic field can be changed, adjusted or varied by mechanically adjusting or rotating at least one of the shells, unless both shells are rotated in opposite directions by the same angle θ, the composite field direction will change as well as its taper and magnitude.

The inner shell 71 and outer shell 72 are both composed of permanent magnetic segments, with the inner shell 71 being composed of inner magnetic segments 73, and the outer shell 72 being composed of outer magnetic sections 74, with each segment a given magnetization, specifically magnitude and direction of remenance. The magnetic segments 73 and 74 interact to generate a magnetic field in the working space within common internal cavity 75. Thus, it can be understood that inner shell 71 and outer shell 72 each independently generate a magnetic field in the working space of common internal cavity 75.

The inner shell 71 produces a first component magnetic field having a given magnitude or field-strength. The given field-strength is determined by the geometric addition of the magnitude and direction of remenance components of magnetization of magnetic segments 73 and 74. Thus, a change in the relative position of inner shell 71 with respect to outer shell 72 will change the interaction, or addition of the magnetization components magnitude and direction of remenance of its permanent magnet segment 73. Changing the interaction of magnetic segments 73 and 74 can result in a change in the field-strength of the composite magnetic field 79 produced by inner shell 71 in the working space along polar plane 76.

Similarly, the magnetic field produced by outer shell 72 interacts with the first component working field in working space along the polar plane 76 to produce a second component field having a given taper. The given taper is determined by the geometric addition of the magnetization components of magnitude and direction of remenance of the magnetic segments comprising outer shell 72. A change in the relative position of permanent magnet outer shell 72 with respect to permanent magnet inner shell 71 will influence the interaction, or addition, of the magnetization components of magnitude and direction of remenance of the permanent magnet segments 74 that form outer shell 72. Changing the interaction of the magnetic segments 74 results in a change to the taper of the composite magnetic field 79 produced by outer shell 72 in the working space within the common internal cavity 75.

Figure 10:
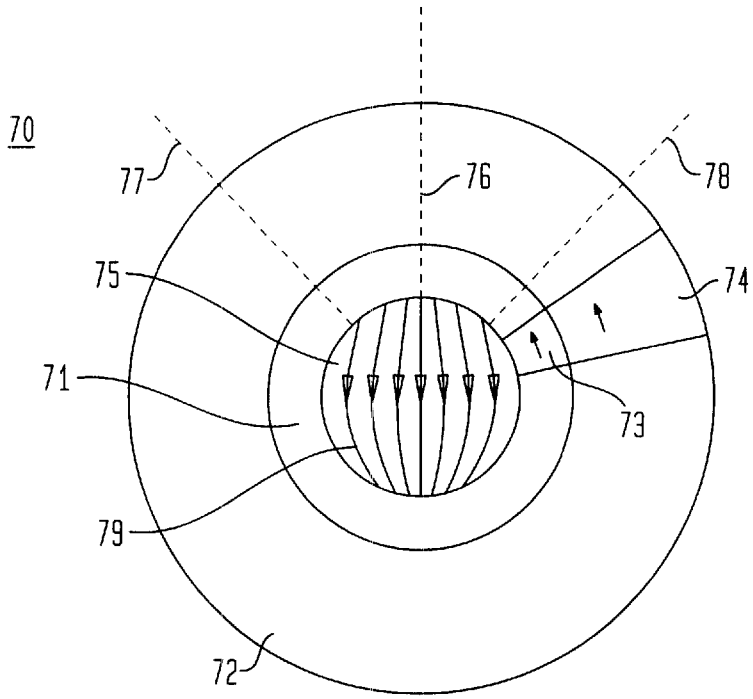
FIG. 10 is a front conceptual view of the variable tapered magic cylinder of the present invention showing the magic cylinders rotated in opposite directions.

FIG. 10 is a front conceptual view of this invention that depicts the field lines of the composite tapered magnetic field when the inner 71 and outer 72 shells have been adjusted by rotating them in opposite directions by the same amount, in accordance with the present invention, using the same numerals for like structural elements and only a few segments 73 and 74 for the sake of clarity. The first component field produced by inner shell 71 and the second component field produced by outer shell 72 interact in the working space within the common internal cavity 75. An inner shell polar plane 77 and outer shell polar plane 78 are shown pointing toward the working space 76, which contains field lines 79 after shell adjustment now pointing downward toward the center of common internal cavity 75 in roughly the same direction as the polar plane 76, but not quite as spread out as the filed lines 79 were in FIG. 9. When inner shell 71 and outer shell 72 are rotated by the same amount from each other in opposite directions, the difference in spread between the top portion of fields lines 79 and the bottom portion of field lines 79 will decrease. The tapered composite magnetic field 79 thereby has a field-strength and taper dependent on the given field-strength and taper of the first and second component fields. Since the field strength and taper of the first and second component fields can be changed by an adjustment to the relative positions of the inner shell 71 and outer shell 72, the field strength and taper of the tapered working field can also be changed by such adjustments and variations. Thus, in accordance with the principles of the present invention, variable tapered magic cylinder structure provides a tapered working field having both an adjustable field-strength and an adjustable taper.

A number of variations of the present invention are also possible, including forming the structure from two or more magnetic shells and forming the structure form two or more magic rings. Other possible variations include a progressively increased level of intensity along the polar plane, the inner and outer shells being rotatable with respect to each other, the outer segments being larger than the inner segments, the inner segments having a given inner magnetization, inner magnitude and inner direction of remenance, the outer segments having a given outer magnetization, outer magnitude and outer direction of remenance, the inner shell being a magic ring and the outer shell being a magic ring. These and similar variations also apply to the embodiment where the variable tapered magic cylinder device is formed from two or more magnetic shells and forming the structure form two or more magic rings.

Additionally, the present invention also encompasses a method for adjusting a tapered magnetic field and a method of adjusting a tapered magnetic field in a magic ring structure. The method for adjusting a tapered magnetic field comprises the steps of forming an outer magnetic shell from outer permanent magnetic segments to enclose an internal cavity, magnetizing the outer shell, forming an inner magnetic shell smaller than the outer shell with inner permanent magnetic segments, magnetizing the inner shell, inserting the inner shell within the outer shell, defining a working space within the internal cavity, axially aligning the outer and inner shell along a concentric cylindrical axis, generating a first working magnetic field in the working space, generating a second working magnetic field in the working space, providing a polar plane that orthogonally intersects the said concentric cylindrical axis, increasing a level of intensity of each of the inner and outer permanent magnetic segments along the polar plane, generating a composite tapered magnetic field along the polar plane through interaction between the inner and outer shells, forming the inner and outer shells to be moveable with respect to each other, moving the inner shell and the outer shell either alone or with respect to each other to adjust the composite tapered magnetic field and producing a variable tapered magnetic field.

Similarly, the steps in the method for adjusting a tapered magnetic field in a magic ring structure comprise the steps of forming an outer magic ring from outer permanent magnetic segments to enclose an internal cavity, magnetizing the outer ring, forming an inner magic ring smaller than the outer ring from inner permanent magnetic segments, magnetizing the inner ring, inserting the inner ring within the outer ring, providing a working space within the internal cavity, axially aligning the inner and outer rings along a concentric cylindrical axis, generating a first working magnetic field in the working space, generating a second working magnetic field in the working space, providing a polar plane that orthogonally intersects the concentric cylindrical axis, increasing a level of intensity of each of the inner and outer permanent magnetic segments along said polar plane, generating a composite tapered magnetic field along the polar plane through interaction between the inner and outer rings, forming the inner and outer rings to be moveable with respect to each other, moving the inner and outer rings either alone or with respect to each other to adjust the composite tapered magnetic field and producing a variable tapered magnetic field. Many of the variations to the devices of the present invention also apply to these methods.

Additionally, while several embodiments have been illustrated and described, it will be obvious to those skilled in the art that various modifications may be made without departing from the spirit and scope of this invention.

What I claim is:

1. A variable tapered magic cylinder structure, comprising:

an outer magnetic shell composed of a plurality of outer permanent magnetic segments encloses an internal cavity;

an inner magnetic shell, composed of a plurality of inner permanent magnetic segments, is inserted within said outer shell and defines a working space within said internal cavity;

said outer shell and said inner shell being axially aligned along a concentric cylindrical axis;

said inner shell is magnetized to produce a first working magnetic field in said working space;

said outer shell is magnetized to produce a second working magnetic field in said working space;

a polar plane orthogonally intersects said concentric cylindrical axis;

each of said plurality of outer permanent magnetic segments and said plurality of inner permanent magnetic segments having an increased level of intensity along said polar plane;

said inner shell and said outer shell interact to generate a composite tapered magnetic field along said polar plane;

said inner shell and said outer shell being moveable with respect to each other; and said composite tapered magnetic field being adjusted by moving said inner shell and said outer shell either alone or with respect to each other to produce a variable tapered magnetic field.

2. The variable tapered magic cylinder structure, as recited in claim 1, further comprising each of said plurality of outer permanent magnetic segments having a progressively increased level of intensity from a bottom end of said polar plane to a top end of said polar plane.

3. The variable tapered magic cylinder structure, as recited in claim 2, further comprising each of said plurality of inner permanent magnetic segments having said progressively increased level of intensity from said bottom end of the polar plane to said top end of the polar plane.

4. The variable tapered magic cylinder structure, as recited in claim 3, further comprising said outer shell is hollow.

5. The variable tapered magic cylinder structure, as recited in claim 4, further comprising said outer shell being cylindrically shaped.

6. The variable tapered magic cylinder structure, as recited in claim 5, further comprising said inner shell is hollow.

7. The variable tapered magic cylinder structure, as recited in claim 6, further comprising said inner shell being cylindrically shaped.

8. The variable tapered magic cylinder structure, as recited in claim 7, further comprising said second working magnetic field produces a given taper along said polar plane.

9. The variable tapered magic cylinder structure, as recited in claim 8, further comprising said inner shell and outer shell being rotatable with respect to each other.

10. The variable tapered magic cylinder structure, as recited in claim 9, further comprising each of said plurality of outer magnetic segments being larger than each of said plurality of inner magnetic segments.

11. The variable tapered magic cylinder structure, as recited in claim 10, further comprising each of said plurality of inner magnetic segments having a given inner magnetization.

12. The variable tapered magic cylinder structure, as recited in claim 11, further comprising said given inner magnetization including an inner magnitude and an inner direction of remenance.

13. The variable tapered magic cylinder structure, as recited in claim 12, further comprising each of said plurality of outer magnetic segments having a given outer magnetization.

14. The variable tapered magic cylinder structure, as recited in claim 13, further comprising said given outer magnetization including an outer magnitude and an outer direction of remenance.

15. The variable tapered magic cylinder structure, as recited in claim 14, further comprising said outer shell is a magic ring.

16. The variable tapered magic cylinder structure, as recited in claim 15, further comprising said inner shell is a magic ring.

17. A variable tapered magic cylinder device, comprising:

an outer magic ring composed of a plurality of outer permanent magnetic segments encloses an internal cavity;

an inner magic ring, composed of an plurality of inner permanent magnetic segments, is inserted within said outer ring and defines a working space within said internal cavity;

said outer ring and said inner ring being axially aligned along a concentric cylindrical axis;

said inner ring is magnetized to produce a first working magnetic field in said working space;

said outer ring is magnetized to produce a second working magnetic field in said working space;

a polar plane orthogonally intersects said concentric cylindrical axis;

each of said plurality of outer permanent magnetic segments and said plurality of inner permanent magnetic segments having an increased level of intensity along said polar plane;

said inner ring and outer ring interact to generate a composite tapered magnetic field in along said polar plane;

said inner ring and said outer ring being moveable with respect to each other; and said composite tapered magnetic field being adjusted by moving said inner ring and said outer ring either alone or with respect to each other to produce a variable tapered magnetic field.

18. The variable tapered magic cylinder structure, as recited in claim 17, further comprising each of said plurality of outer permanent magnetic segments having a progressively increased level of intensity from a bottom end of said polar plane to a top end of said polar plane.

19. The variable tapered magic cylinder structure, as recited in claim 18, further comprising each of said plurality of inner permanent magnetic segments having said progressively increased level of intensity from said bottom end of the polar plane to said top end of the polar plane.

20. The variable tapered magic cylinder device, as recited in claim 19, further comprising said outer ring is hollow.

21. The variable tapered magic cylinder device, as recited in claim 20, further comprising said outer ring being cylindrically shaped.

22. The variable tapered magic cylinder device, as recited in claim 21, further comprising said inner ring is hollow.

23. The variable tapered magic cylinder device, as recited in claim 22, further comprising said inner ring being cylindrically shaped.

24. The variable tapered magic cylinder device, as recited in claim 23, further comprising said second working magnetic field produces a given taper along said polar plane.

25. The variable tapered magic cylinder device, as recited in claim 24, further comprising said inner ring and outer ring being rotatable with respect to each other.

26. The variable tapered magic cylinder device, as recited in claim 25, further comprising each of said plurality of outer magnetic segments being larger than each of said plurality of inner magnetic segments.

27. The variable tapered magic cylinder device, as recited in claim 26, further comprising each of said plurality of inner magnetic sections having a given inner magnetization.

28. The variable tapered magic cylinder device, as recited in claim 27, further comprising said given inner magnetization including an inner magnitude and an inner direction of remenance.

29. The variable tapered magic cylinder device, as recited in claim 28, further comprising each of said plurality of outer magnetic segments having a given outer magnetization.

30. The variable tapered magic cylinder device, as recited in claim 29, further comprising said given outer magnetization including an outer magnitude and an outer direction of remenance.

31. A method of adjusting a tapered magnetic field, comprising the steps of:

forming an outer magnetic shell from a plurality of outer permanent magnetic segments to enclose an internal cavity;

magnetizing said outer shell;

forming an inner magnetic shell smaller than said outer shell from a plurality of inner permanent magnetic segments;

magnetizing said inner shell;

inserting said inner shell within said outer shell;

defining a working space within said internal cavity;

axially aligning said outer shell and said inner shell along a concentric cylindrical axis;

generating a first working magnetic field in said working space;

generating a second working magnetic field in said working space;

providing a polar plane that orthogonally intersects said concentric cylindrical axis;

increasing a level of intensity of each of said plurality of outer permanent magnetic segments and said plurality of inner permanent magnetic segments along said polar plane;

generating a composite tapered magnetic field along said polar plane through interaction between said inner shell and said outer shell;

forming said inner shell and said outer shell to be moveable with respect to each other;

moving said inner shell and said outer shell either alone or with respect to each other to adjust said composite tapered magnetic field; and producing a variable tapered magnetic field.

32. The method of adjusting a tapered magnetic field, as recited in claim 31, further comprising the step of generating said first working magnetic field from said inner shell.

33. The method of adjusting a tapered magnetic field, as recited in claim 32, further comprising the step of generating said second working magnetic field from said outer shell.

34. The method of adjusting a tapered magnetic field, as recited in claim 33, further comprising the step of providing a progressively increased level of intensity in each of said plurality of outer permanent magnetic segments from a bottom end of said polar plane to a top end of said polar plane.

35. The method of adjusting a tapered magnetic field, as recited in claim 34, further comprising the step of providing said progressively increased level of intensity in each of said plurality of inner permanent magnetic segments from said bottom end of the polar plane to said top end of the polar plane.

36. The method of adjusting a tapered magnetic field, as recited in claim 35, further comprising the step of forming said outer shell to be hollow.

37. The method of adjusting a tapered magnetic field, as recited in claim 36, further comprising the step of shaping said outer shell to be cylindrical.

38. The method of adjusting a tapered magnetic field, as recited in claim 37, further comprising the step of forming said inner shell to be hollow.

39. The method of adjusting a tapered magnetic field, as recited in claim 38, further comprising the step of shaping said inner shell to be cylindrical.

40. The method of adjusting a tapered magnetic field, as recited in claim 39, further comprising the step of producing a given taper along said polar plane from said second working magnetic field.

41. The method of adjusting a tapered magnetic field, as recited in claim 40, further comprising the step of providing a first tapered magnetic field from said plurality of inner magnetic segments.

42. The method of adjusting a tapered magnetic field, as recited in claim 41, further comprising the step of providing a second tapered magnetic field from said plurality of outer magnetic segments.

43. The method of adjusting a tapered magnetic field, as recited in claim 42, further comprising the step of forming said inner shell and outer shell to be rotatable with respect to each other.

44. The method of adjusting a tapered magnetic field, as recited in claim 43, further comprising the steps of forming each of said plurality of outer magnetic segments to be larger than each of said plurality of inner magnetic segments.

45. The method of adjusting a tapered magnetic field, as recited in claim 44, further comprising the step of forming each of said plurality of inner magnetic segments with a given inner magnetization.

46. The method of adjusting a tapered magnetic field, as recited in claim 45, further comprising the step of providing an inner magnitude and an inner direction of remenance with said given inner magnetization.

47. The method of adjusting a tapered magnetic field, as recited in claim 46, further comprising the step of providing each of said plurality of outer magnetic segments with a given outer magnetization.

48. The method of adjusting a tapered magnetic field, as recited in claim 47, further comprising the step of providing an outer magnitude and an outer direction of remenance with said given outer magnetization.

49. The method of adjusting a tapered magnetic field, as recited in claim 48, wherein said outer shell is a magic ring.

50. The method of adjusting a tapered magnetic field, as recited in claim 49, wherein said inner shell is a magic ring.

51. A method of adjusting a tapered magnetic field in a magic ring structure, comprising the steps of:

forming an outer magic ring from a plurality of outer permanent magnetic segments to enclose an internal cavity;

magnetizing said outer ring;

forming an inner magic ring smaller than said outer ring from a plurality of inner permanent magnetic segments;

magnetizing said inner ring;

inserting said inner ring within said outer ring;

providing a working space within said internal cavity;

axially aligning said outer ring and said inner ring along a concentric cylindrical axis;

generating a first working magnetic field in said working space;

generating a second working magnetic field in said working space;

providing a polar plane that orthogonally intersects said concentric cylindrical axis;

increasing a level of intensity of each of said plurality of outer permanent magnetic segments and said plurality of inner permanent magnetic segments along said polar plane;

generating a composite tapered magnetic field along said polar plane through interaction between said inner ring and said outer ring;

forming said inner ring and said outer ring to be moveable with respect to each other;

moving said inner ring and said outer ring either alone or with respect to each other to adjust said composite tapered magnetic field; and producing a variable tapered magnetic field.

52. The method of adjusting tapered magnetic field in a magic ring structure, as recited in claim 51, further comprising the step of generating said first working magnetic field from said inner ring.

53. The method of adjusting tapered magnetic field in a magic ring structure, as recited in claim 52, further comprising the step of generating said second working magnetic field from said outer ring.

54. The method of adjusting tapered magnetic field in a magic ring structure, as recited in claim 53, further comprising the step of providing a progressively increased level of intensity in each of said plurality of outer permanent magnetic segments from a bottom end of said polar plane to a top end of said polar plane.

55. The method of adjusting tapered magnetic field in a magic ring structure, as recited in claim 54, further comprising the step of providing said progressively increased level of intensity in each of said plurality of inner permanent magnetic segments from said bottom end of the polar plane to said top end of the polar plane.

56. The method of adjusting tapered magnetic field in a magic ring structure, as recited in claim 55, further comprising the step of forming said outer ring to be hollow.

57. The method of adjusting tapered magnetic field in a magic ring structure, as recited in claim 56, further comprising the step of shaping said outer ring to be cylindrical.

58. The method of adjusting tapered magnetic field in a magic ring structure, as recited in claim 57, further comprising the step of forming said inner ring to be hollow.

59. The method of adjusting tapered magnetic field in a magic ring structure, as recited in claim 58, further comprising the step of shaping said inner ring to be cylindrical.

60. The method of adjusting tapered magnetic field in a magic ring structure, as recited in claim 59, further comprising the step of producing a given taper along said polar plane from said second working magnetic field.

61. The method of adjusting tapered magnetic field in a magic ring structure, as recited in claim 60, further comprising the step of providing a first tapered magnetic field from said plurality of inner magnetic segments.

62. The method of adjusting tapered magnetic field in a magic ring structure, as recited in claim 61, further comprising the step of providing a second tapered magnetic field from said plurality of outer magnetic segments.

63. The method of adjusting tapered magnetic field in a magic ring structure, as recited in claim 62, further comprising the step of forming said inner ring and said outer ring to be rotatable with respect to each other.

64. The method of adjusting tapered magnetic field in a magic ring structure, as recited in claim 63, further comprising the steps of forming each of said plurality of outer magnetic segments to be larger than each of said plurality of inner magnetic segments.

65. The method of adjusting tapered magnetic field in a magic ring structure, as recited in claim 64, further comprising the step of forming each of said plurality of inner magnetic segments with a given inner magnetization.

66. The method of adjusting tapered magnetic field in a magic ring structure, as recited in claim 65, further comprising the step of providing an inner magnitude and an inner direction of remenance with said given inner magnetization.

67. The method of adjusting tapered magnetic field in a magic ring structure, as recited in claim 66, further comprising the step of providing each of said plurality of outer magnetic segments with a given outer magnetization.

68. The method of adjusting tapered magnetic field in a magic ring structure, as recited in claim 67, further comprising the step of providing an outer magnitude and an outer direction of remenance with said given outer magnetization.

* * * * *